US007980316B2

(12) United States Patent
Swenson et al.

(10) Patent No.: US 7,980,316 B2
(45) Date of Patent: Jul. 19, 2011

(54) FORMATION ISOLATION VALVE

(75) Inventors: Brad Swenson, Houston, TX (US); Arin Basmajian, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 304 days.

(21) Appl. No.: 12/108,186

(22) Filed: Apr. 23, 2008

(65) Prior Publication Data

US 2009/0266556 A1 Oct. 29, 2009

(51) Int. Cl.
*E21B 34/06* (2006.01)
*E21B 43/00* (2006.01)

(52) U.S. Cl. ..... 166/386; 166/373; 166/323

(58) Field of Classification Search ..... 166/373, 166/386, 323
See application file for complete search history.

(56) References Cited

U.S. PATENT DOCUMENTS

| | | | | | |
|---|---|---|---|---|---|
| 3,310,114 | A * | 3/1967 | Dollison | 166/322 |
| 3,750,752 | A * | 8/1973 | Mott | 166/319 |
| 4,252,143 | A * | 2/1981 | Fredd | 137/115.26 |
| 4,372,390 | A * | 2/1983 | Baugh et al. | 166/373 |
| 4,457,368 | A | 7/1984 | Knierimen et al. | |
| 4,537,383 | A * | 8/1985 | Fredd | 251/58 |
| 4,574,889 | A * | 3/1986 | Pringle | 166/386 |
| 4,723,606 | A * | 2/1988 | Vinzant et al. | 166/319 |
| 4,928,772 | A * | 5/1990 | Hopmann | 166/386 |
| 4,962,813 | A | 10/1990 | Welch | |
| 4,967,845 | A * | 11/1990 | Shirk | 166/386 |
| 5,348,087 | A * | 9/1994 | Williamson, Jr. | 166/115 |
| 5,390,735 | A * | 2/1995 | Williamson, Jr. | 166/115 |
| 5,617,918 | A * | 4/1997 | Cooksey et al. | 166/115 |
| 5,950,733 | A | 9/1999 | Patel | |
| 5,957,208 | A * | 9/1999 | Schnatzmeyer | 166/373 |
| 6,230,807 | B1 | 5/2001 | Patel | |
| 6,302,216 | B1 | 10/2001 | Patel | |
| 6,659,186 | B2 | 12/2003 | Patel | |
| 6,662,877 | B2 | 12/2003 | Patel | |
| 6,991,040 | B2 * | 1/2006 | Hill, Jr. et al. | 166/373 |
| 7,347,272 | B2 | 3/2008 | Patel et al. | |
| 2004/0007365 | A1 * | 1/2004 | Hill, Jr. et al. | 166/386 |
| 2009/0229828 | A1 * | 9/2009 | Ross | 166/319 |
| 2009/0266556 | A1 * | 10/2009 | Swenson et al. | 166/373 |

FOREIGN PATENT DOCUMENTS

| | | |
|---|---|---|
| EP | 0892148 | 1/1999 |

* cited by examiner

*Primary Examiner* — Jennifer H Gay
(74) *Attorney, Agent, or Firm* — Brandon S. Clark; Rodney Warfford

(57) ABSTRACT

A valve includes a housing, a valve element that is located in the housing, an operator, a locking device and an interference device. The housing includes an interior surface that has a profile. The operator may be configured to transition the valve element between open and closed states. The locking device is adapted to be selectively extended into the profile. The interference device may be adapted to be selectively extended radially inside the locking device to retain the locking device in the profile, thereby locking the valve element in the open or closed state.

21 Claims, 8 Drawing Sheets

FORMATION ISOLATION VALVE

BACKGROUND

The invention generally relates to a formation isolation valve.

A formation isolation valve may be used in a well for such purposes as preventing fluid loss and controlling an underbalanced condition. The valve forms a controllable sealed access to formations below the valve. When the valve is open, well equipment (a tubular string, a wireline system, a slickline system, etc.) may be deployed through the valve for purposes of performing one or more testing, perforating and/or completion functions below the valve. After these functions are complete, the well equipment may be retrieved, and the valve may be subsequently closed.

For purposes of opening and closing the valve, a tool, such as a shifting tool that is disposed at the end of a string, may be used to physically engage the valve. More specifically, the shifting tool interacts with a mechanical section of the valve. The mechanical section typically is tied to a barrier valve element (a ball valve element, for example) of the valve so that linear motion of the shifting tool (caused by controlled movement of a string connected to the shifting tool, for example) acts to either directly or indirectly open or close the valve element. In addition, the mechanical section holds the valve element in position (i.e., keeps the valve either open or closed) after the shifting tool is removed from the valve.

As a more specific example, the mechanical section of a typical formation isolation valve may include at least one collet that is constructed to engage a detent for purposes of locking the valve in either an open or closed position. When a sufficient force is applied to the mechanical section by the shifting tool to overcome a shifting force threshold, the collet is released from the detent to unlock the valve. The movement of the collet may scrape the interior of the valve and may wear down the holding edge or face of the collet, thereby decreasing the holding capability of the collet. Additionally, the shifting force threshold that must be overcome to release the collet from the detent relies largely on the flexibility of the collet and the angular relationship between the holding edge or face of the collet head and the detent. As a result, the shifting force threshold may be inconsistent and somewhat unreliable from unit to unit.

The mechanical section should have a relatively high holding force and a relatively low shifting force threshold. The holding force and the shifting force threshold, however, are established by the same geometry of the collet and the detent. Therefore, challenges exist in designing a formation isolation valve that satisfactorily satisfies both criteria.

SUMMARY

In an embodiment of the invention, a valve includes a housing, a valve element that is located in the housing, an operator, a locking device and an interference device. The housing includes an interior surface that has a profile, and the operator transitions the valve element between open and closed states. The locking device is adapted to be selectively extended into the profile to lock the valve element in the open or closed state. The interference device is adapted to be selectively extended radially inside the locking device to retain the locking device in the profile.

In another embodiment of the invention, a valve includes a housing, a valve element that is located in the housing, an operator, a locking device and an interference device. The housing includes an interior surface that has first and second profiles. The operator transitions the valve element between open and closed states. The locking device is adapted to be selectively extended into the first profile to lock the valve element in the open state and extend into the second profile to lock the valve element in the closed state. The interference device is adapted to be selectively extended radially inside the locking device to retain the locking device in the first or second profile.

In yet another embodiment of the invention, a technique includes selectively extending a locking device into a profile of a housing of a downhole tool to lock the tool in one of a plurality of states. The technique includes selectively extending an interference device radially inside the locking device to retain the locking device in the profile.

Advantages and other features of the invention will become apparent from the following drawing, description and claims.

BRIEF DESCRIPTION OF THE DRAWING

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
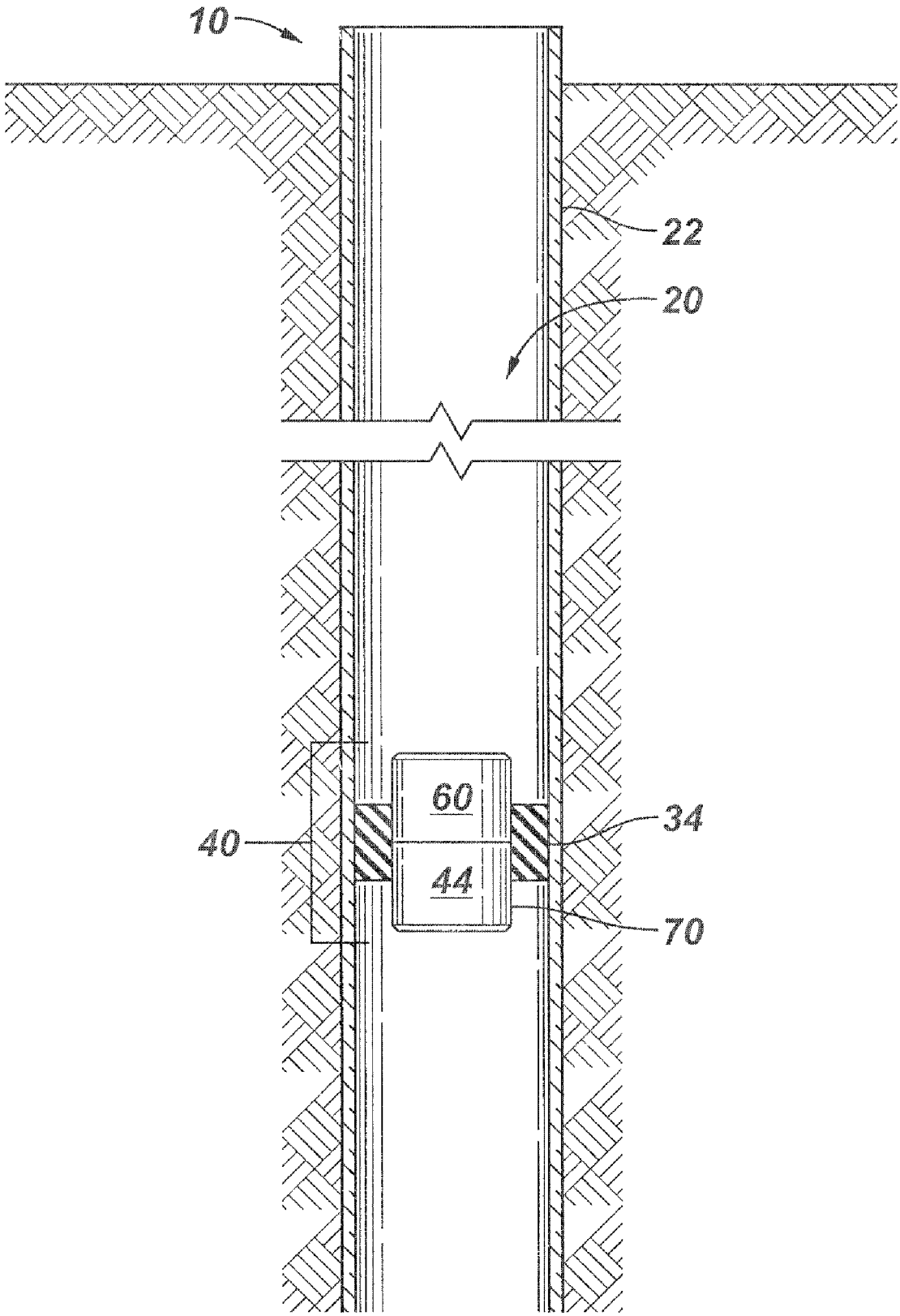
FIG. 1 is a schematic diagram of a well according to an embodiment of the invention.

Referring to FIG. 1, an illustrative embodiment 40 of a formation isolation valve in accordance with the invention controls access to a region of a well 10 (a subsea well or a subterranean well) below the valve 40. In this regard, the valve 40 is located downhole in a wellbore 20 and permits well equipment, such as a tubular string (as a non-limiting example), to pass through the valve 40 to the region beneath the valve 40 when the valve 40 is in an open state. Conversely, when the valve 40 is in a closed state, the valve 40 seals off fluid communication with the region beneath the valve 40.

An annular region, or annulus, which is located between an exterior surface of the valve 40 and an interior surface of tubular string 22 may be sealed off by a packer 34. In accordance with some embodiments of the invention, the tubular string 22 may be a casing string that supports the wellbore 20 or may be a production tubing string, as just a few examples.

It is noted that, however, the well 10 may be uncased in accordance with some embodiments of the invention. Thus, many variations and applications of the valve 40 are contemplated and are within the scope of the appended claims.

In general, the valve 40 includes a valve actuator 60 and a valve element 44 that forms a controllable barrier for the valve 40. As examples, the valve element 44 may be a ball-type valve control element or a flapper-type valve control element. Other types of valve control elements are contemplated and are within the scope of the appended claims.

The actuator 60 operates the valve element 44 for purposes of controlling the state (open or closed) of the valve element 44 (thus, controlling the state of the valve 40). In this regard, the valve element 44 may be mechanically engaged by a tool, such as a shifting tool, which is run downhole into the central passageway of the valve 40 for purposes of opening and closing the valve 40. However, in other arrangements, the actuator 60 may be electrically or hydraulically operated, and/or may be remotely operated in response to a stimulus (a wired stimulus, a wireless stimulus, an acoustic stimulus, a pressure pulse stimulus, an electromagnetic stimulus, seismic stimulus, etc.) that is communicated downhole from the surface of the well. Therefore, although a shifting tool is described herein, for purposes of example, as engaging and operating the actuator 60, it is understood that other mechanisms and techniques may be used to open and close the valve element 44, in accordance with other embodiments of the invention.

The actuator 60, in accordance with some embodiments of the invention, includes an operator mandrel that is generally concentric with the longitudinal axis of the valve 40 and translates along the longitudinal axis for purposes of opening and closing the valve element 44. More specifically, in a particular longitudinal position, the actuator 60 causes the valve element 44 to open, and in another longitudinal position, the actuator 60 causes the valve element 44 to close. As described in more detail below, the operator mandrel may be locked in position to effectively lock the valve element 44 (and thus, lock the valve 40) either open or closed. For this purpose, a retractable locking device is used, as described below, to secure the operator mandrel to the housing of the valve 44.

Unlike conventional formation isolation valves, the valve 40 may include an interference device that may be moved radially inside or otherwise engaged with the locking device to prevent the locking device from disengaging (i.e., to prevent the locking device from backing out of its locking engagement) until the valve 40 is to be transitioned to a different state. By using this approach, the valve 40 has a relatively high holding force (i.e., the force that retains the valve in a particular state), and the valve 40 has a relatively low shifting force threshold for purposes of releasing the lock so that the valve 40 may be transitioned to another state. This high holding force may allow the valve 40 to be run in a closed state if needed for particular well applications. Also, the valve 40 may only be shifted if a particular mandrel is actuated. Accordingly, the locked in valve 40 may be relatively immune to inadvertent shifting of the valve 40 due to the associated stresses of run in.

Figure 2:
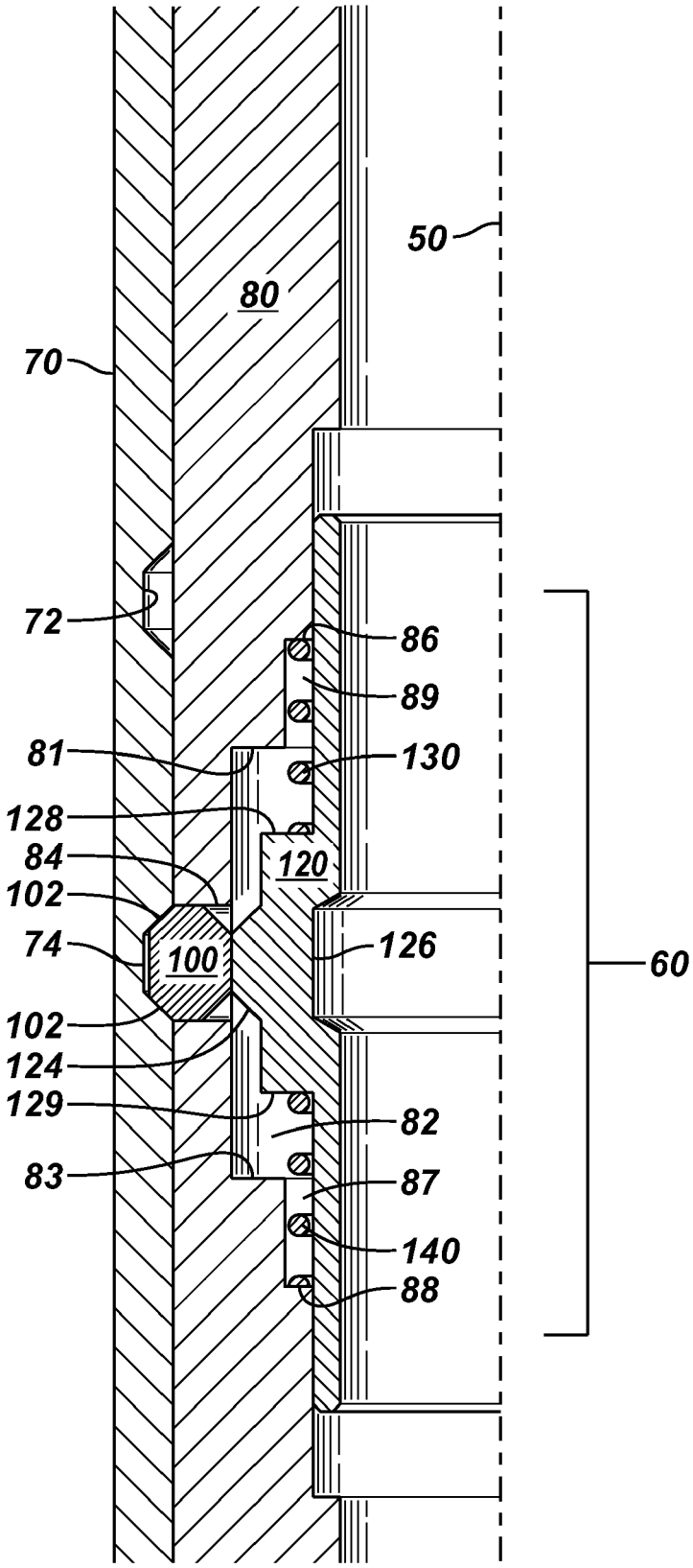
FIGS. 2, 3 and 4 are partial cross-sectional views illustrating a formation isolation valve according to an embodiment of the invention.

Referring to FIG. 2, as a more specific example, in accordance with some embodiments of the invention, the valve 40 includes a valve housing 70 that is generally concentric about a longitudinal axis 50 of the valve 40. It is noted that FIG. 2 and proceeding FIGS. 3 and 4 depict a partial left hand cross-section of the valve 40, although it is understood that, in general, the valve 40 includes a mirroring right hand cross-section that would be shown on the right hand side of the longitudinal axis 50 in a full cross-sectional view.

The valve 40 includes an operator mandrel 80 that is located inside the housing 70 and is generally concentric with the longitudinal axis 50. In general, the operator mandrel 80 moves up and down to actuate the valve element 44 (see FIG. 1). FIG. 2 depicts a longitudinal position of the mandrel 80 for a particular state (e.g., in an open state or a closed state for example) of the valve element 44. In this state, the mandrel 80 is locked in position to therefore, lock the valve element 44 in a particular open or closed state. In other words, for the state that is depicted in FIG. 2, the position of the mandrel 80 relative to the housing 70 is fixed due to a locking element, such as a dog 100, which radially extends through the sidewall of the mandrel 80 into a lower profile 74 that is formed in the interior surface of the housing 70.

The lower profile 74 is associated with a particular state of the valve element 44, and an upper profile 72, which may also formed in the interior surface of the housing 70 is associated with another state of the valve element 44. For example, in accordance with some embodiments of the invention, the lower profile 74 may be associated with an open state of the valve element 44, and the upper profile 72 may be associated with a closed state of the valve, although this relationship may be reversed in accordance with other embodiments of the invention.

Figure 3:
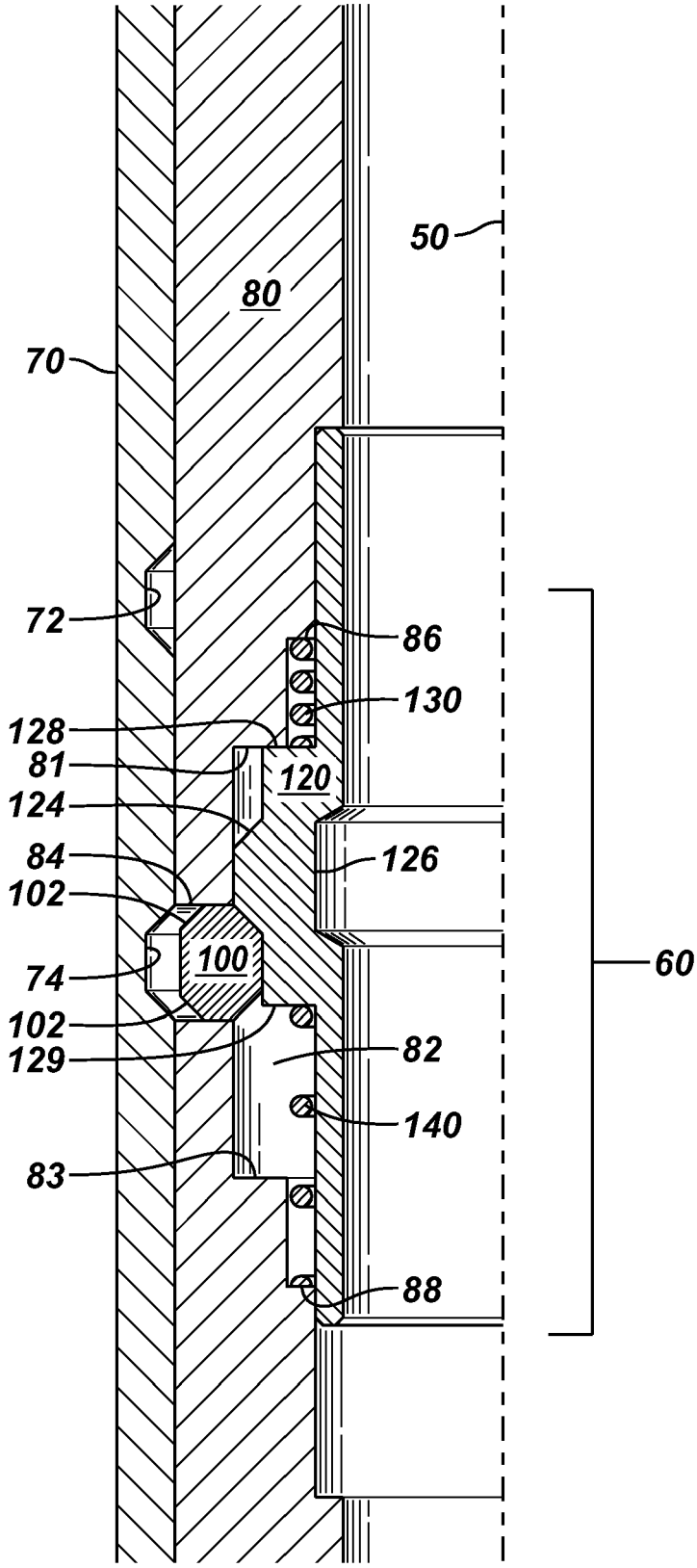
Figure 4:
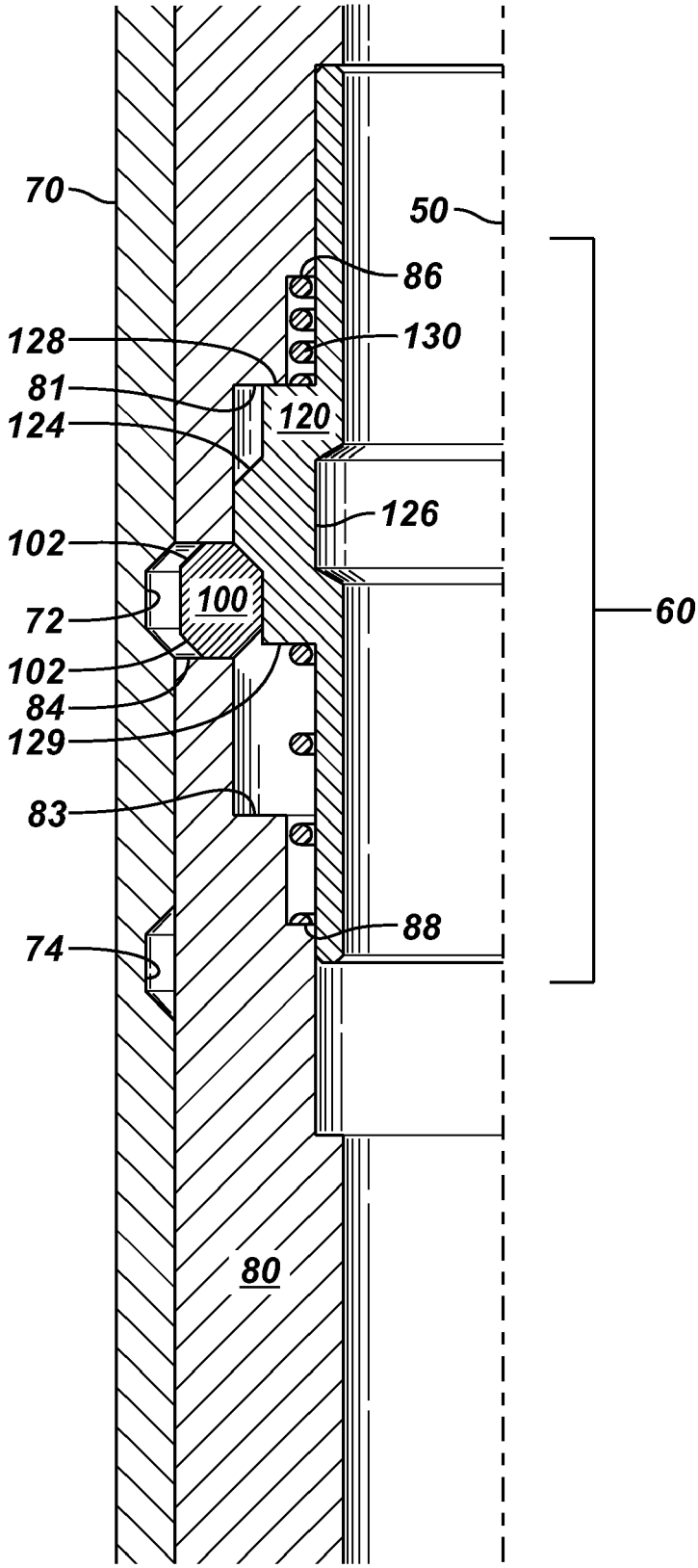

It is noted that FIG. 2 as well as proceeding FIGS. 3 and 4 depict a single dog 100 and a single profile in the housing 70 for each state of the valve 40. However, as can be appreciated by one of skill in the art, the valve 40 may contain multiple profiles and thus, may contain multiple locking elements and profiles for each state of the valve 40. For example, intermediate states or states other than open and closed may be associated with individual profiles and their corresponding locking elements. In addition, the profiles may be configured to work only with a correspondingly keyed dog, thereby preventing inadvertent or unintentional shifting of the valve 40 via shifting tools or components used for other purposes. Thus, many variations are contemplated and are within the scope of the appended claims.

For the state of the valve, which is depicted in FIG. 2, the dog 100 extends through a radially-disposed opening 84 of the mandrel 80 and into the lower profile 74, which complementarily receives the dog 100. As an example, the dog 100 includes inclined, or beveled, surfaces 102 that engage corresponding surfaces of the lower profile 74 (as well as the upper profile 72 when inserted) for purposes of producing forces that tend to the move the dog 100 out of the profile 72, 74 due to the wedge-derived forces that are generated when an upward or downward force on the dog 100 is exerted on the mandrel 80. However, when the valve element 44 is "locked," the dog 100 is prevented from moving out of the profile due to the presence of a mechanical interference device, such as a sleeve 120, in accordance with some embodiments of the invention.

It is noted that other mechanisms may be used to produce a force for purposes of retracting the dog 100 from the profile 72, 74. For example, in other embodiments of the invention, stored energy (a compressed spring, gas, etc.) or a combination of stored energy and wedge interaction may be used to exert a retraction force on the dog 100.

As depicted in FIG. 2, the sleeve 120 is generally concentric with the longitudinal axis 50 and may extend radially into a recessed annular region 82 of the mandrel 80. The sleeve 120 includes an extension 124 that, as depicted in FIG. 2, extends radially outwardly to contact the inner surface of the dog 100 when the dog 100 is in the profile 74 to prevent the dog 100 from being forced out of the profile 74. For the state of the valve 40, which is depicted in FIG. 2, the valve element 44 is locked into a particular open or closed state, as the dog 100 prevents relative movement between the mandrel 80 and the housing 70.

In accordance with embodiments of the invention, upper 130 and lower 140 coiled springs bias the position of the sleeve 120 so that the sleeve 120 has an equilibrium position (i.e., a position when no forces by a tool, such as a shifting tool, for example, are exerted on the sleeve 120), in which the extension 124 is aligned with the opening 84 of the mandrel 80 (as depicted in FIG. 2). It is noted, however, that the sleeve 120 may be biased into this equilibrium position by other mechanisms (gas-charged "springs," for example), in accordance with other embodiments of the invention. Thus, when no other forces act on the sleeve 120, the sleeve 120 is in position to prevent the dog 100 from backing out of the profile 72, 74 provided in the housing 70.

The upper spring 130 is located in an inner, annular recessed region 89 of the operator mandrel 80 and extends between a downwardly facing shoulder 86 of the mandrel 80 and an upwardly facing shoulder 128 of the sleeve 120. Thus, in this position, the spring 130 exerts a downwardly directed force on the sleeve 120. The downwardly directed force that is produced by the upper spring 130 is opposed by an upwardly directed force that is produced by the lower spring 140.

As shown in FIG. 2, in general, the lower spring 140 is located in an inner annular recessed region 87 of the mandrel 80 and, more particularly, is disposed between a downwardly facing shoulder 129 of the sleeve 120 and an upwardly facing shoulder 88 of the mandrel 80. Thus, due to the biasing of the springs 130 and 140, the extension 124 of the sleeve 120 is positioned radially inside the dog 100 to prevent the dog 100 from exiting the profile 74, thereby locking the valve 40 in position.

In accordance with embodiments of the invention, the valve element 44 may be unlocked by applying force to the sleeve 120 via a shifting tool, for example. Thus, the transition force, or shifting force threshold, needed to change the valve 40 between states is established by the springs 130 and 140. The shifting force threshold of the valve 40 is therefore relatively small, as the required shifting force is independent from the holding force, which is relatively large, due to the mechanical interference created by the sleeve 120. In addition, the springs 130 and 140 may be configured to provide a relatively consistent shifting force for a wide range of applications.

As a specific example, the inner surface of the sleeve 120 may include a profile 126 that is constructed to be engaged by a shifting tool. The engagement of the sleeve 120 by the shifting tool, in turn, may be used to move the sleeve 120 to remove or disengage the mechanical interference occurring at the extension 124 to permit the above-described retraction force to drive the dog 100 out of the profile 74.

As a more specific example, FIG. 3 depicts a state of the valve 40 in which the sleeve 120 has been shifted upwardly by a shifting tool (not shown) so that the upwardly facing shoulder 128 of the sleeve 120 contacts a downwardly forcing shoulder 81 of the mandrel 80. As shown, the upper spring 130 is compressed and establishes the shifting force threshold that must be overcome for this example. Due to the contact between the sleeve 120 and the mandrel 80, the sleeve 120 exerts an upward force on the mandrel 80. This upward force, by way of the wedge action created by the inclined surfaces of the dog 100 and profile 74, creates a radial retraction force component to drive the dog 100 out of the profile 74.

With the dog 100 being retracted from the lower profile 74, the mandrel 80 is free to move with respect to the housing 70, and thus, the sleeve 120 and mandrel 80 continue in an upward direction due to the upward force that is exerted by the shifting tool until the dog 100 is aligned with the upper profile 72, as depicted in FIG. 4. For this position of the mandrel 80, the valve element 44 may now be in the opposite state (e.g., either a closed state or an open state). When the shifting tool releases the sleeve 120, the force that is exerted by the upper spring 130 drives the sleeve 120 back into its equilibrium position, which forces the dog 100 into the upper profile 72 (due to the interaction of the inclined surfaces of the dog 100 and extension 124). At this point, the mandrel 80 is secured relative to the housing 70, which locks the valve element 44 (and valve 40) in a particular state.

To transition the valve element 44 back to the original state (FIG. 2), the shifting tool may be used to engage the sleeve 120, shift the sleeve 120 downwardly, and ultimately shift the mandrel 80 downwardly. Afterwards, the shifting tool may release the sleeve 120 to engage the lock.

Other embodiments are contemplated and are within the scope of the appended claims. For example, in accordance with other embodiments of the invention, the formation isolation valve 40 may be replaced by a formation isolation valve having an actuator 200, which is schematically depicted in a partial schematic diagram in FIG. 5. It is noted that FIG. 5 depicts a left hand cross-section of the valve 200, which is generally symmetrical about a longitudinal axis 201 of the valve 200, with it being understood that the mirroring right hand cross-section about the longitudinal axis 201 is omitted but would be present in a full cross-sectional view of the valve.

Figure 5:
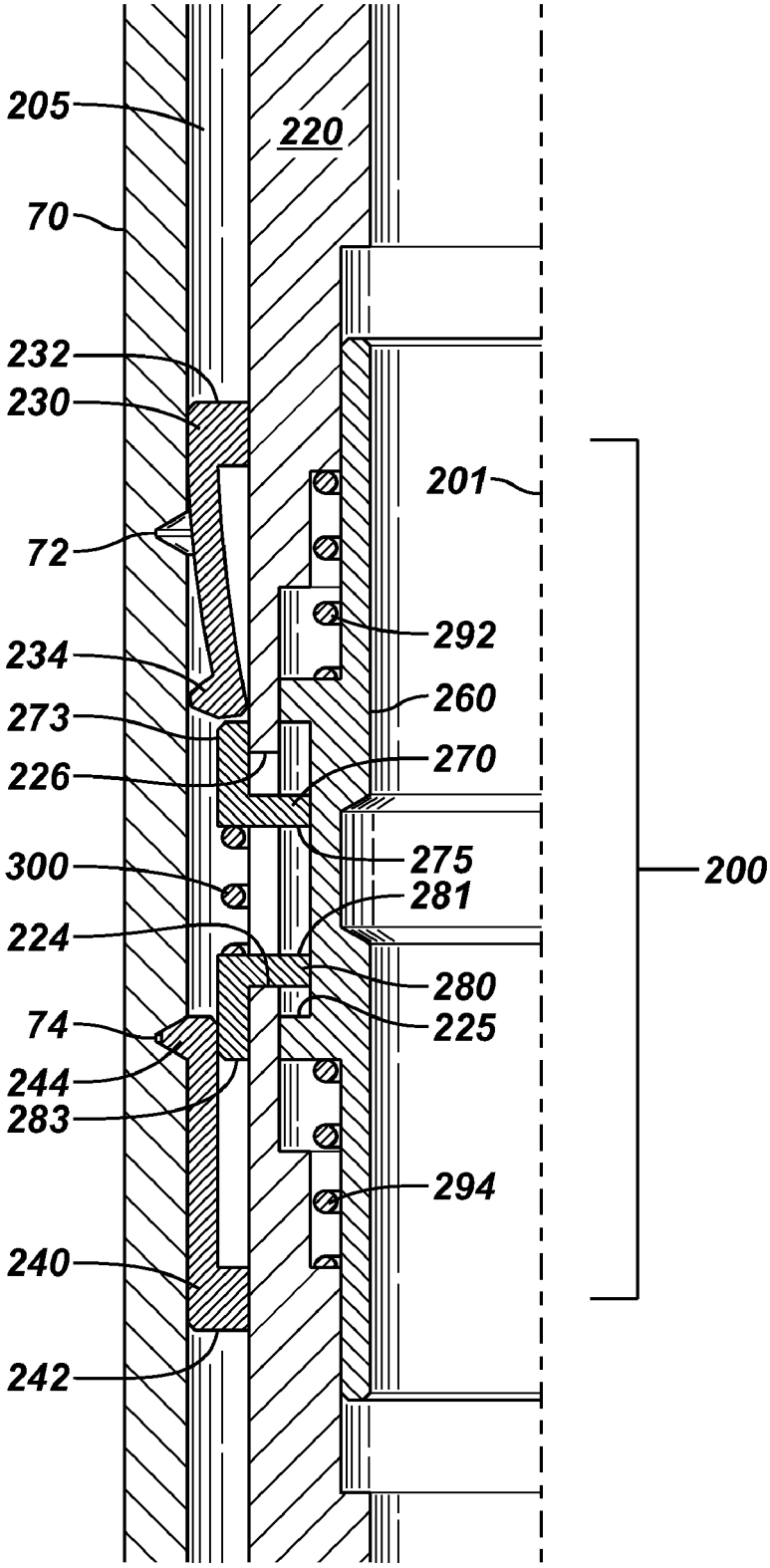
FIGS. 5, 6 and 7 are partial cross-sectional views illustrating a formation isolation valve according to another embodiment of the invention.

Instead of using one or more dogs as locking devices to secure an operator mandrel 220 of the valve of FIG. 5 with respect to a valve housing 70, the valve uses upper 230 and lower 240 collets that are attached to the mandrel 220 and are located in an annular space 205 between the mandrel 220 and the housing 70. Each collet 230, 240 has a fixed end that is secured to the mandrel 220 and a free end that is used to selectively engage one of the profiles 72 and 74, depending on the state of the valve 200.

More specifically, in accordance with some embodiments of the invention, the upper collet 230 may be associated with the upper profile 72 so that when a collet head 234 at the free end of the collet 230 is engaged in the profile 72, the mandrel 220 is locked in a particular position associated with either an open or closed state of the valve 200. Similarly, the lower collet 240 may be associated with the lower profile 74 such that when a collet head 244 located at the free end of the collet 240 is engaged with the lower profile 74 (as depicted in FIG. 5), the mandrel 220 is secured in another position associated with another state of the valve 200. The collet heads 234 and 244 each have inclined surfaces similar to the dog 100 (see FIGS. 2, 3 and 4) for purposes of creating a retraction force that tends to drive the head 234, 244 out of the profile 74, 72, when a longitudinal force is applied by the mandrel 220. In some embodiments, each of the upper and lower collet heads 234, 244 and their corresponding upper and lower profiles 72, 74 may be different than one another such that upper collet head 234 may only fit within upper profile 72. As depicted in FIG. 5, the collets 230 and 240 are secured to the mandrel 220 at fixed ends 232 and 242, respectively.

A sleeve 260 of the actuator 200 replaces the sleeve 120 of the actuator 60 (see FIGS. 3, 4 and 5). In general, the sleeve 260 is concentric with the longitudinal axis 201 and is located inside the mandrel 220. In particular, the sleeve 260 is suspended between an upper coiled spring 292 and a lower coiled spring 294. For this example, FIG. 5 depicts an equilibrium position of the sleeve 260, and in this equilibrium position, the collet head 244 of the collet 240 engages the profile 74. As shown, the valve 200 includes upper 270 and lower 280 locking members that create mechanical interferences for the collets 230 and 240, respectively, depending on the particular state of the valve.

In this regard, as depicted in FIG. 5, the lower locking member 280 has a longitudinal protrusion 283 that extends radially inside the collet head 244 to provide a mechanical interference to keep the collet head 244 locked inside the profile 74. The locking member 280 also includes an inwardly radially extending protrusion 281 that extends through a radially disposed opening 226 of the mandrel 220 and rests on an upwardly facing shoulder 224 of the mandrel 220 for the state that is depicted in FIG. 5.

The locking member 270 includes a radially extending inward protrusion 275 and a longitudinally extending protrusion 273. A coiled spring 300 resides between the locking members 270 and 280. Thus, due to the downward force exerted by the spring 300, for the state of the valve depicted in FIG. 5, the locking member 280 provides a mechanical interference that locks the collet head 244 in the profile 74.

Figure 6:
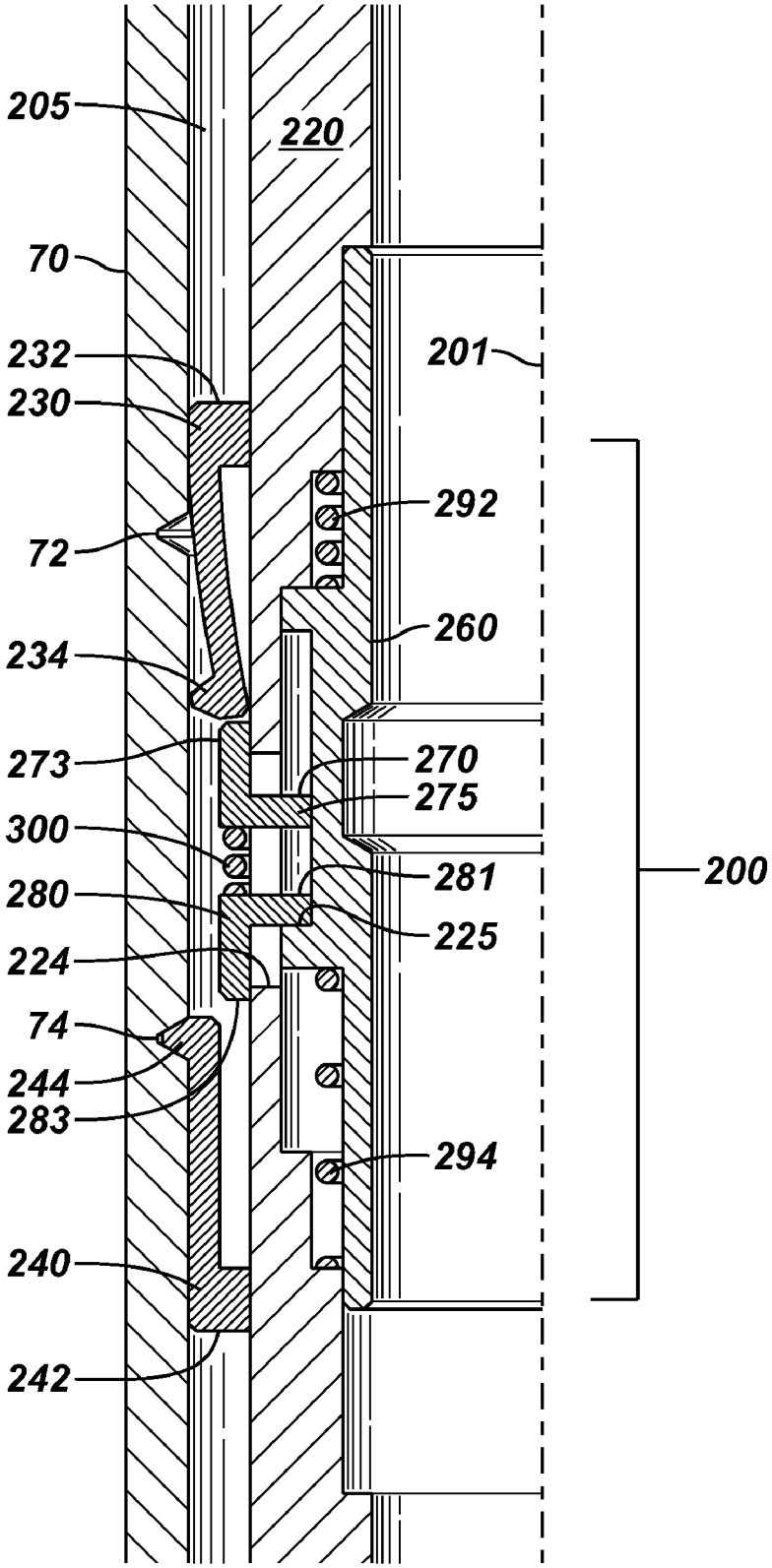

FIG. 6 depicts the transition of the valve from the state depicted in FIG. 5 to another state. In this regard, to transition the valve between states, a shifting tool (not shown) applies an upward force to the sleeve 260 such that an upwardly facing shoulder 225 of the sleeve 260 engages the radial protrusion 281 of the locking member 280. Thus, upper movement of the sleeve 260 eventually dislodges the longitudinal protrusion 283 of the locking element 280 to remove the mechanical interference behind the collet head 244, as depicted in FIG. 6. Because the collet 240 is attached to the mandrel 220, continued upward movement of the mandrel 220 exerts a force to drive the collet head 244 from the lower profile 74, which is now permitted due to the removal of the longitudinal protrusion 283 of the locking member 280.

Figure 7:
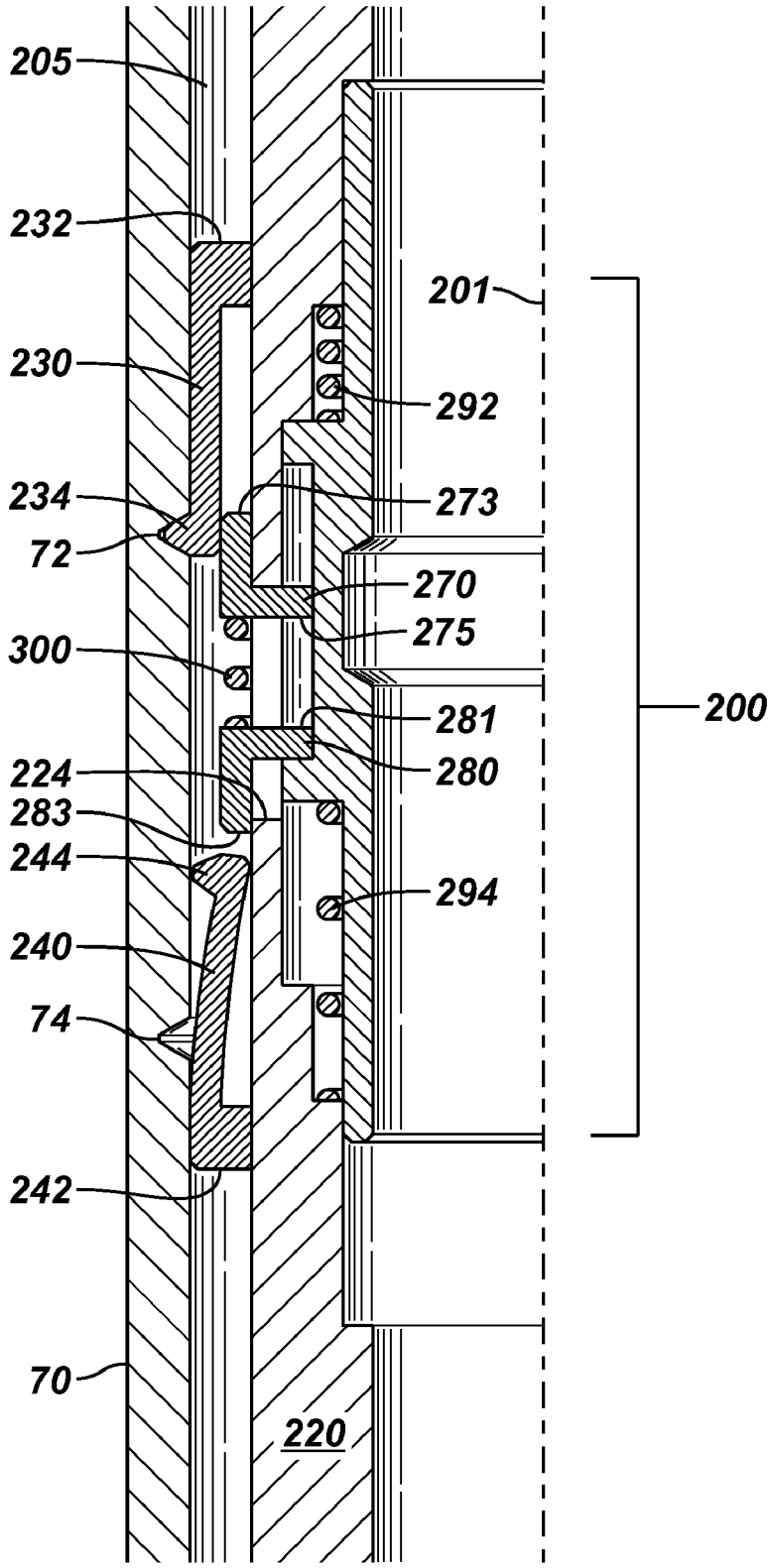

Thus, the valve 220 may be transitioned to the other state, which is depicted in FIG. 7. As shown, in this state, due to the upward movement of the locking member 280, and the force exerted by the coiled spring 300, the locking member 270 moves upwardly to force the collet head 234 of the upper collet 230 into the profile 72. The longitudinal protrusion 273 of the locking member 270 therefore provides a mechanical interference to prevent the collet head 234 from being forced out of the profile 72, regardless of the force exerted on the mandrel 220. The valve may be transitioned back to the other state by movement of the sleeve 260 (by the shifting tool) in the opposite direction.

Other embodiments are contemplated and are within the scope of the appended claims. For example, in accordance with other embodiments of the invention, the formation isolation valve actuator 200 may be replaced by a formation isolation valve actuator 400 in another valve, which is schematically depicted in a partial schematic diagram in FIG. 8. It is noted that FIG. 8 depicts a left hand cross-section of the valve, which is generally symmetrical about a longitudinal axis 450 of the valve, with it being understood that the mirroring right hand cross-section about the longitudinal axis 450 is omitted but would be present in a full cross-sectional view of the valve.

Figure 8:
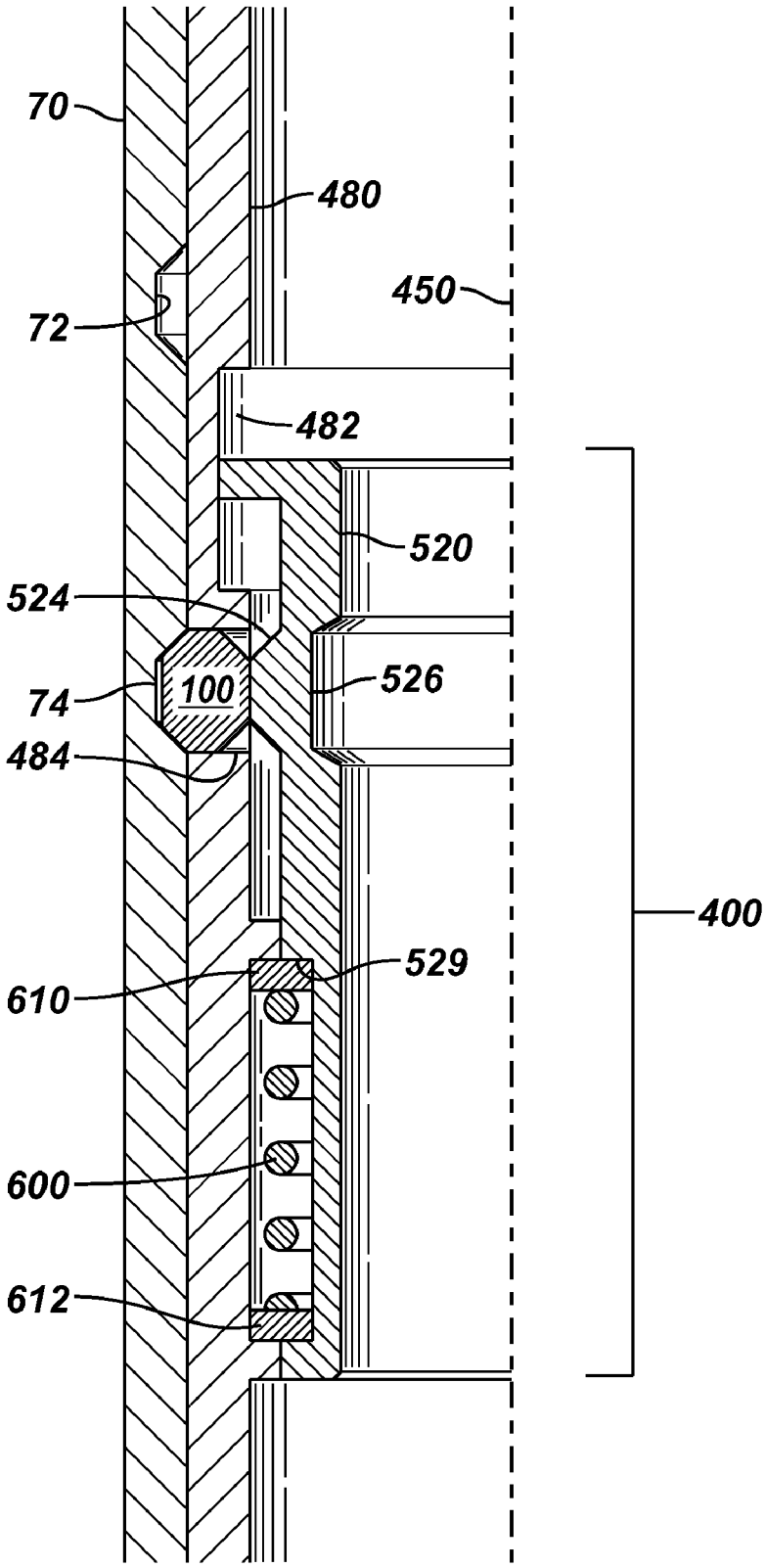
FIG. 8 is a partial cross-sectional view illustrating a formation isolation valve according to a further embodiment of the invention.

The valve of FIG. 8 may include a valve housing 70 containing an upper and lower profile 72 and 74 as previously described. In addition, a dog 100 may be used in a manner similar to previous embodiments. However, an operator mandrel 480 may be used in place of operator mandrel 80 and a mechanical interference device such as a sleeve 520 may be used in place of sleeve 120, in accordance with some embodiments of the invention.

It is noted that other mechanisms may be used to produce a force for purposes of retracting the dog 100 from the profile 72, 74. For example, in other embodiments of the invention, stored energy (a compressed spring, gas, etc.) or a combination of stored energy and wedge interaction may be used to exert a retraction force on the dog 100.

As depicted in FIG. 8, the sleeve 520 is generally concentric with the longitudinal axis 450 and may extend radially into a recessed annular region 482 of the mandrel 480. The sleeve 520 includes an extension 524 that, as depicted in FIG. 8, extends radially outwardly to contact the inner surface of the dog 100 when the dog 100 is in the profile 74 to prevent the dog 100 from being forced out of the profile 74. For the state of the valve 400, which is depicted in FIG. 8, the valve is locked into a particular open or closed state, as the dog 100 prevents relative movement between the mandrel 480 and the housing 70.

In accordance with embodiments of the invention, a resilient member or coiled spring 600 biases the position of the sleeve 520 so that the sleeve 520 has an equilibrium position (i.e., a position when no forces by a tool, such as a shifting tool, for example, are exerted on the sleeve 520), in which the extension 524 is aligned with the opening 484 of the mandrel 480 (as depicted in FIG. 8). It is noted, however, that the sleeve 520 may be biased into this equilibrium position by other mechanisms (gas-charged "springs," for example), in accordance with other embodiments of the invention. Thus, when no other forces act on the sleeve 520, the sleeve 520 is in position to prevent the dog 100 from backing out of the profile 72, 74 provided in the housing 70.

Spring 600 may be maintained in place by upper 610 and lower 612 spring retainer rings. The upper and lower spring retainer rings 610, and 612 may shoulder on both the operator mandrel 480 and the sleeve 520. Accordingly, when the sleeve 520 is moved in either direction longitudinally along the longitudinal axis 450, the spring 600 is compressed.

Operation of the valve of FIG. 8 is similar to the previously described valve 40. A shifting tool (not shown) may engage the profile 526 located in the sleeve 520 and apply an upward or downward force. To transition the valve of FIG. 8 to another state, the shifting tool engages the sleeve 520 and provides an upward force. The sleeve 520 moves upward, compressing spring 600. The extension 524 moves away from the radially inward surface of the dog 100, permitting the above-described retraction force to drive the dog 100 out of the profile 74. Further application of force moves the sleeve 520 and the operator mandrel 480 upward until the dog 100 engages profile 72. Once dog 100 is engaged with profile 72, the sleeve 520 may be released, resulting in the extension 524 being moved via the force of the spring 600 into a mechanical interference position radially inward of the dog 100. The valve 400 is then locked in place in the new state.

The holding and locking mechanisms that are described herein may be applied to tools other than formation isolation valves, in accordance with other embodiments of the invention. For example, in accordance with other embodiments of the invention, the above-described locking and holding mechanisms may be applied to a sleeve valve. Furthermore, the holding and locking mechanisms that are described herein may be applied to downhole tools other than valves, in accordance with yet other embodiments of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A valve usable with a well, comprising:

a housing comprising an interior surface having a first profile;

a valve element located in the housing;

an operator to transition the valve element between an open state and a closed state;

a locking device adapted to be selectively extended into the first profile to lock the valve element in the open or closed state; and an interference device adapted to be biased to a first position relative to the locking device at which the interference devices extends radially inside the locking device to retain the locking device in the first profile, the interference device comprising a second profile to be engaged by a shifting tool to allow the interference device to be moved to a second position relative to the locking device at which the interference device no longer retains the locking device in the first profile, wherein the interference device is adapted to return to the first position when not engaged by the shifting tool.

2. The valve of claim 1, wherein the locking device comprises a dog.

3. The valve of claim 1, wherein the operator comprises a mandrel.

4. The valve of claim 3, wherein the mandrel comprises a radially disposed opening, and the locking device is adapted to selectively extend through the opening to lock a position of the mandrel relative to the housing.

5. The valve of claim 3, wherein the locking device is attached to the mandrel.

6. The valve of claim 1, wherein the interference device comprises a sleeve.

7. The valve of claim 6, wherein the sleeve comprises an interior surface comprising the second profile.

8. A valve usable with a well, comprising:

a housing comprising an interior surface having a first profile and a second profile;

a valve element located in the housing;

an operator to transition the valve element between an open state and a closed state;

a locking device adapted to be selectively extended into the first profile to lock the valve element in the open state and selectively extended into the second profile to lock the valve element in the closed state; and an interference device adapted to be biased to a first position relative to the locking device to extend radially inside the locking device to retain the locking device in the first or second profile, the interference device comprising a third profile to be engaged by a shifting tool to allow the interference device to be moved to a second position relative to the locking device at which the interference device no longer retains the locking device in the first or second profile, wherein the interference device is adapted to return to the first position in response to being disengaged from the shifting tool.

9. The valve of the claim 8, wherein the locking device comprises a dog.

10. The valve of the claim 8, wherein the locking device comprises a first collet adapted to extend into the first profile to lock the valve in the open state and a second collet adapted to extend into the second profile to lock the valve element in the closed state.

11. The valve of claim 10, wherein the locking device is attached to the mandrel.

12. The valve of claim 8, wherein the operator comprises a mandrel.

13. The valve of claim 12, wherein the mandrel comprises a radially disposed opening, and the locking device is adapted to selectively extend through the opening to lock a position of the mandrel relative to the housing.

14. The valve of claim 8, wherein the valve comprises a formation isolation valve.

15. A method, comprising:

selectively extending a locking device into a profile of a housing of a downhole tool to lock the tool in one of a plurality of states;

biasing an interference device to be disposed at a biased position at which the interference device radially extends inside the locking device to retain the locking device in the profile;

engaging the interference device with a shifting tool to displace the interference device from a biased position such that the interference device no longer retains the locking device in the profile disengaging the interference device from the shifting tool; and using the biasing of the interference device to return the interference device to the biased position in response to disengagement of the interference device from the shifting tool.

16. The method of claim 15, wherein the act of selectively extending the locking device comprises extending a dog.

17. The method of claim 15, wherein the act of selectively extending the locking device comprises securing an operator mandrel of the tool to the housing.

18. The method of claim 17, wherein the mandrel has a radially disposed opening, and the act of selectively extending the locking device comprises extending the locking device through the opening to lock a position of the mandrel relative to the housing.

19. The method of claim 17, further comprising:

attaching the locking device to the mandrel.

20. The method of claim 15, wherein the tool comprises a formation isolation valve.

21. The method of claim 15, wherein the act of engaging comprises engaging a sleeve.

* * * * *